US009881601B2

(12) United States Patent
Barnes et al.

(10) Patent No.: US 9,881,601 B2
(45) Date of Patent: Jan. 30, 2018

(54) CONTROLLING STABILITY IN ANR DEVICES

(71) Applicant: Bose Corporation, Framingham, MA (US)

(72) Inventors: Christopher A. Barnes, Saugus, MA (US); Ricardo F. Carreras, Southborough, MA (US); Daniel M. Gauger, Jr., Berlin, MA (US)

(73) Assignee: Bose Corporation, Framingham, MA (US)

( * ) Notice: Subject to any disclaimer, the term of this patent is extended or adjusted under 35 U.S.C. 154(b) by 321 days.

(21) Appl. No.: 13/915,220

(22) Filed: Jun. 11, 2013

(65) Prior Publication Data

US 2014/0363010 A1 Dec. 11, 2014

(51) Int. Cl.
*G10K 11/178* (2006.01)
*H04R 1/10* (2006.01)

(52) U.S. Cl.
CPC ..... *G10K 11/1788* (2013.01); *H04R 1/1083* (2013.01); *G10K 2210/3039* (2013.01); *G10K 2210/3056* (2013.01); *H04R 2460/01* (2013.01)

(58) Field of Classification Search
CPC ..... G10K 11/1788; G10K 2210/3056; G10K 2210/3089; G10K 2210/3028; G10K 11/178; H04R 1/1083; H04R 2460/01
USPC ..... 381/71.6, 71.1, 71.11, 71.14, 74, 56
See application file for complete search history.

(56) References Cited

U.S. PATENT DOCUMENTS 8,073,150 B2 12/2011 Joho et al.
8,073,151 B2 12/2011 Joho et al.
2009/0034748 A1* 2/2009 Sibbald ..... 381/71.6
2010/0272281 A1* 10/2010 Carreras ..... G10K 11/178 381/71.6

(Continued)

FOREIGN PATENT DOCUMENTS

GB 2455823 * 6/2009
GB 2455823 A * 6/2009

(Continued)

OTHER PUBLICATIONS

International Search Report and Written Opinion dated Feb. 5, 2015 for International application No. PCT/US2014/040641.

(Continued)

*Primary Examiner* — Duc Nguyen
*Assistant Examiner* — Yogeshkumar Patel
(74) *Attorney, Agent, or Firm* — Fish & Richardson P.C.

(57) ABSTRACT

Stability is provided in an active noise reduction (ANR) headphone by measuring a sound field to generate an input signal, filtering and applying a variable gain to the input signal to produce a first filtered signal using a first filter and a variable gain amplifier in an ANR signal pathway, outputting the filtered signal, and simultaneously with outputting the first filtered signal, sampling a signal at a point in the ANR signal pathway and filtering the sampled signal using a second filter to produce a second filtered signal. The second filtered signal is compared to a threshold, and if the comparison finds that the second filtered signal is greater than the threshold signal, the gain of the variable gain amplifier is changed to attenuate the first filtered signal. The second filter applies different gains, different by at least 10 dB, in different frequency ranges between 10 Hz and 10 kHz.

28 Claims, 8 Drawing Sheets

(56) References Cited

U.S. PATENT DOCUMENTS

| | | | | |
|---|---|---|---|---|
| 2012/0057720 | A1* | 3/2012 | Van Leest ..... | G10K 11/1782<br>381/71.11 |
| 2013/0315411 | A1 | 11/2013 | Annunziato et al. | |

FOREIGN PATENT DOCUMENTS

| | | | | |
|---|---|---|---|---|
| JP | 2012-529061 | | | 11/2012 |
| JP | 2012/529061 | A | * | 11/2012 |
| WO | 2010129219 | A1 | | 11/2010 |
| WO | 2010131154 | A1 | | 11/2010 |
| WO | WO 2010/129219 | | * | 11/2010 |
| WO | WO 2010/129219 | A1 | * | 11/2010 |
| WO | WO 2010/129272 | A1 | * | 11/2010 |

OTHER PUBLICATIONS

Notice of Reasons for Rejection, with English Translation; Appln. No. 2016-519539; Dec. 21, 2016; 6 pages.

* cited by examiner

CONTROLLING STABILITY IN ANR DEVICES

BACKGROUND

This disclosure relates to controlling stability in acoustic noise reducing (ANR) devices, and in particular ANR devices using an in-ear form factor.

U.S. Pat. Nos. 8,073,150 and 8,073,151, incorporated here by reference, describe a digital signal processor for use in an ANR system that allows the system designer to configure numerous aspects of the system. In particular, the designer can configure the signal flow topology within the signal processor, and the coefficients of filters applied to signals at numerous points within the topology. Such designs can also be implemented in analog circuits.

SUMMARY

In general, in one aspect, providing stability in an active noise reduction (ANR) headphone includes measuring a sound field to generate a first input signal, filtering and applying a variable gain to the first input signal to produce a first filtered signal using a first filter and a first variable gain amplifier in an ANR signal pathway, outputting the first filtered signal, and simultaneously with outputting the first filtered signal, sampling a signal at a point in the ANR signal pathway and filtering the sampled signal using a second filter to produce a second filtered signal. The second filtered signal is compared to a threshold, and if the comparison finds that the second filtered signal is greater than the threshold signal, the gain of the first variable gain amplifier is changed to attenuate the first filtered signal. The second filter applies first and second gains in respective first and second frequency ranges between 10 Hz and 10 kHz, the first and second gains being different by at least 10 dB.

Implementations may include one or more of the following, in any combination. The second filter may include a high-pass filter that attenuates signals below a first frequency range and passes signals within the first frequency range that may be indicative of instability in the ANR signal pathway. The second filter may include a multiple shelf filter that applies a first gain to signals below a first frequency range, applies a second gain to signals within the first frequency range, and applies a third gain to signals above the first frequency range. The second filter may attenuate signals in a first frequency range, in which high signal levels may result in instability in the ANR signal pathway, by at least 10 dB and passes signals below the first frequency range. The second filter may attenuate signals completely at a frequency defining the lower bound of the first frequency range. The sampling may provide the first filtered signal to the second filter. The sampling may provide the first input signal to the second filter. The first variable gain amplifier may be located before the first filter. The first variable gain amplifier may be located after the first filter. The ANR signal pathway may include a feed-forward ANR pathway, and the sound field may be measured outside the ANR headphone as an input to the feed-forward ANR pathway.

The ANR signal pathway may include a feed-back ANR pathway, and the sound field may be measured inside the ANR headphone as an input to the feed-back ANR pathway, the first and second filtered signals being first and second filtered feed-back signals. The first filtered feed-back signal may be combined with a filtered input audio signal to produce a first combined signal, and the sampling may provide the first combined signal to the second filter. The sampling may provide the first combined signal to the second filter after the first combined signal is further combined with a filtered feed-forward signal to produce a second combined signal. The second filtered feed-back signal may be compared to a second threshold, and if the comparison finds that the second filtered feed-back signal is greater than the second threshold signal, changing the gain of a second variable gain amplifier on an audio input path to attenuate an audio input signal. The second threshold may be less than the first threshold.

A sound field may be measured outside the ANR headphone to generate a first input feed-forward signal to a feed-forward ANR pathway, in which the first input feed-forward signal is filtered and amplified to produce a first filtered feed-forward signal using a third filter and a second variable gain amplifier. The first filtered feed-forward signal is output and combined with the first filtered feed-back signal to produce a combined output signal, and simultaneously with outputting the first filtered feed-forward signal, a signal is sampled at a point in the feed-forward ANR pathway and the sampled signal is filtered using a fourth filter to produce a second filtered feed-forward signal. The second filtered feed-forward signal is compared to a second threshold, and if the comparison finds that the second filtered feed-forward signal is greater than the second threshold signal, the gain of the second variable gain amplifier is changed to attenuate the first filtered feed-forward signal. The fourth filter may apply first and second gains in respective first and second frequency ranges between 10 Hz and 10 kHz, the first and second gains being different by at least 10 dB. The fourth filter may include a high-pass filter that attenuates signals below a first frequency range and passes signals within the first frequency range that may be indicative of instability in the feed-forward ANR pathway. The ANR signal pathway may be implemented using a configurable digital signal processor.

In general, in one aspect, an active noise reduction (ANR) system includes a feed-back ANR signal pathway including a feed-back microphone, a first variable gain amplifier, and a first filter, a feed-forward ANR signal pathway including a feed-forward microphone, a second variable gain amplifier and a second filter, an audio input signal pathway, and an output transducer converting signals from each of the feed-back ANR signal pathway, the feed-forward ANR signal pathway, and the audio input signal pathway to acoustic output signals. At least one of the feed-back ANR signal pathway and the feed-forward ANR signal pathway includes a first side-chain loop sampling a signal within the respective pathway, applying a third filter to the sampled signal, and adjusting at least the first or second variable gain amplifier based on a comparison of the output of the third filter to a threshold. The third filter applies first and second gains in respective first and second frequency ranges between 10 Hz and 10 kHz to the sampled signal, the first and second gains being different by at least 10 dB.

Implementations may include one or more of the following, in any combination. The first side-chain loop may sample a signal output by the feed-back ANR signal pathway and the third filter attenuates signals in a first frequency range, in which high signal levels may result in instability in the feed-back loop, by at least 10 dB and passes signals below the first frequency range. The audio signal pathway may include a third variable gain amplifier, and a second side-chain loop may receive the output of the third filter from the first side-chain loop and adjust the third variable gain amplifier based on a comparison of the output of the third filter to a second threshold. The first side-chain loop may sample a signal output by the feed-forward ANR signal pathway and the third filter may include a high-pass filter that attenuates signals below a first frequency range and passes signals within the first frequency range that may be indicative of instability in the feed-forward ANR signal pathway. The first side-chain loop may sample a summed signal including a signal output by the feed-back ANR signal pathway and a signal output by the audio input signal pathway. The first side chain loop may sample a signal from within one of the feed-back or feed-forward ANR signal pathways prior to the first or second variable gain amplifiers and first or second fillers. The feed-forward and feed-back ANR signal pathways may include an integrated configurable digital signal processor.

In general, in one aspect, providing stability in a digital feed-back loop of an active noise reduction (ANR) headphone includes measuring a sound field inside the ANR headphone to generate a first input feed-back signal, filtering and applying a variable gain to the first input feed-back signal to produce a first filtered feed-back signal using a first filter and a first variable gain amplifier in a feed-back ANR pathway, outputting the first filtered feed-back signal, and simultaneously with outputting the first filtered feed-back signal, sampling the feed-back signal at a point in the feed-back ANR pathway and filtering the sampled signal using a second filter to produce a second filtered feed-back signal, comparing the second filtered feed-back signal to a threshold, and if the comparison finds that the second filtered feed-back signal is greater than the threshold signal, changing the gain of the variable gain amplifier to attenuate the first feed-back signal. The second filter applies first and second gains in respective first and second frequency ranges between 10 Hz and 10 kHz, the first and second gains being different by at least 10 dB.

In general, in one aspect, providing stability in a digital feed-forward pathway of an active noise reduction (ANR) headphone includes measuring a sound field outside the ANR headphone to generate a first input feed-forward signal, filtering and applying a variable gain to the first input feed-forward signal to produce a first filtered feed-forward signal using a first filter and a first variable gain amplifier in a feed-forward ANR pathway, outputting the first filtered feed-forward signal, and simultaneously with outputting the first filtered feed-forward signal, sampling the feed-forward signal at a point in the feed-forward ANR pathway and filtering the sampled signal using a second filter to produce a second filtered feed-forward signal, comparing the second filtered feed-forward signal to a threshold, and if the comparison finds that the second filtered feed-forward signal is greater than the threshold signal, changing the gain of the variable gain amplifier to attenuate the first filtered feed-forward signal. The filter for producing the second filtered feed-forward signal applies first and second gains in respective first and second frequency ranges between 10 Hz and 10 kHz, the first and second gains being different by at least 10 dB.

Advantages include balancing stability controls with quality considerations, and avoiding false-triggering of stability controls.

All examples and features mentioned above can be combined in any technically possible way. Other features and advantages will be apparent from the description and the claims.

DESCRIPTION

U.S. Pat. Nos. 8,073,150 and 8,073,151 describe a configurable digital signal processor, and include a number of demonstrative signal flow topologies and filter configurations. This disclosure describes several particular embodiments of an ANR system implemented using the signal processor described in those patents, representing particular configurations found to be particularly effective.

Figure 1:
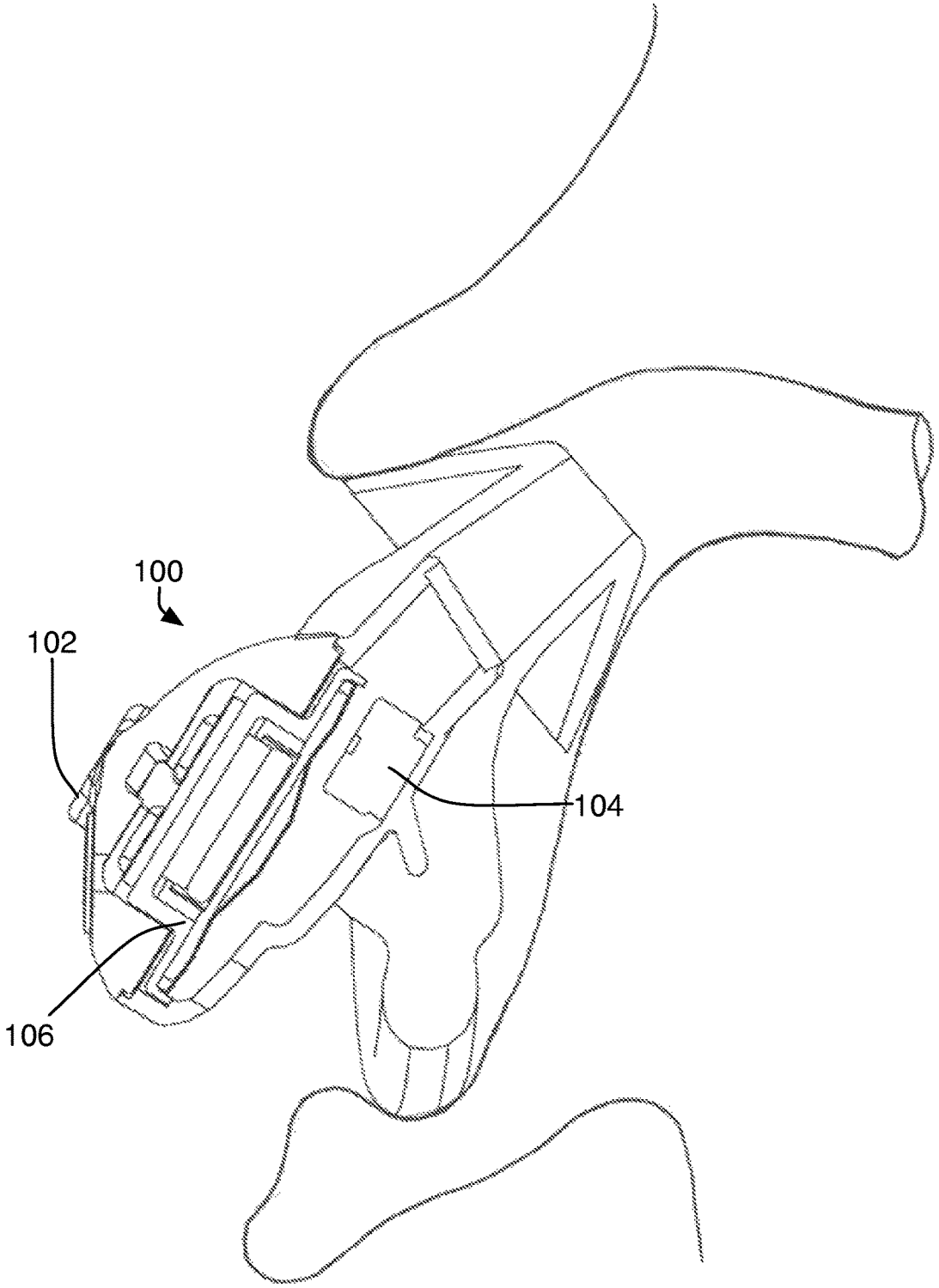
FIG. 1 shows an in-the-ear active noise reduction headphone.

Patent application Ser. No. 13/480,766 (now U.S. Pat. No. 9,082,388), filed May 25, 2012, and incorporated here by reference, describes the acoustic implementation of an in-ear acoustic noise reducing (ANR) headset, as shown in FIG. 1. This headset 100 includes a feed-forward microphone 102, a feed-back microphone 104, an output transducer 106, and a noise reduction circuit (not shown) coupled to both microphones and the output transducer to provide anti-noise signals to the output transducer based on the signals detected at both microphones. An additional input (not shown) to the circuit provides additional audio signals, such as music or communication signals, for playback over the output transducer 106 independently of the noise reduction signals.

Various techniques are used to reduce unwanted artifacts that occur when an ANR system is exposed to signals that push the system beyond the limits of its normal linear operating range. Such limits include clipping of amplifiers (PGAs or output amplifiers), hard excursion limits of drivers, or levels of excursion that cause sufficient change in the acoustics response so as to cause oscillation. Artifacts can be oscillation, as well as objectionable transients ("thuds" or "cracks") and even crackling/buzzing resulting from the sound of noise comprised of a mix of low and high frequencies where the canceling signal (the mirror image of the noise) has been clipped. Such artifacts can be reduced in some cases by temporarily lowering the gain along selected portions of the signal processing pathways, so that a transient increase in noise from the lowering of the gain is less objectionable than the artifact being addressed. Lowering the gain in this way may also be referred to as compressing or limiting the signal pathway.

Patent application Ser. No. 13/667,103 (now U.S. Pat. No. 8,798,283), filed Nov. 2, 2012, and incorporated here by reference describes the use of modified filters in a feed-forward noise reduction path to provide ambient naturalness, rather than maximum noise reduction, in an ANR headset. One of the problems discovered in implementing an in-ear ANR headset with an ambient naturalness feature is instability caused when a user cups his hand around one of the earbuds, while the earbud is out of the ear and in an ambient naturalness mode. In this situation, a feed-back loop is formed between the feed-forward microphone and the output transducer, via the air path around the earbud. This feed-back loop causes amplification of the ambient noise, resulting in squealing that is audible even though the earbud is not in the user's ear. Another situation that can cause audible artifacts in an in-ear ANR headset is when a limiter used to assure stability of the feed-back noise cancellation loop during extreme noise transient conditions (due to the system exceeding its normal linear operating range) may be mistakenly triggered by high signal levels in an audio signal, such as music, that is to be played back simultaneously with the noise cancellation signals and has energy in the frequency range where the limiter is attempting to detect instability artifacts. The system will incorrectly see the high signal levels of music as the sort of instability it is attempting to detect. The system will inappropriately reduce the feed-back loop gain in an attempt to resolve the erroneously-detected instability.

Figure 2:
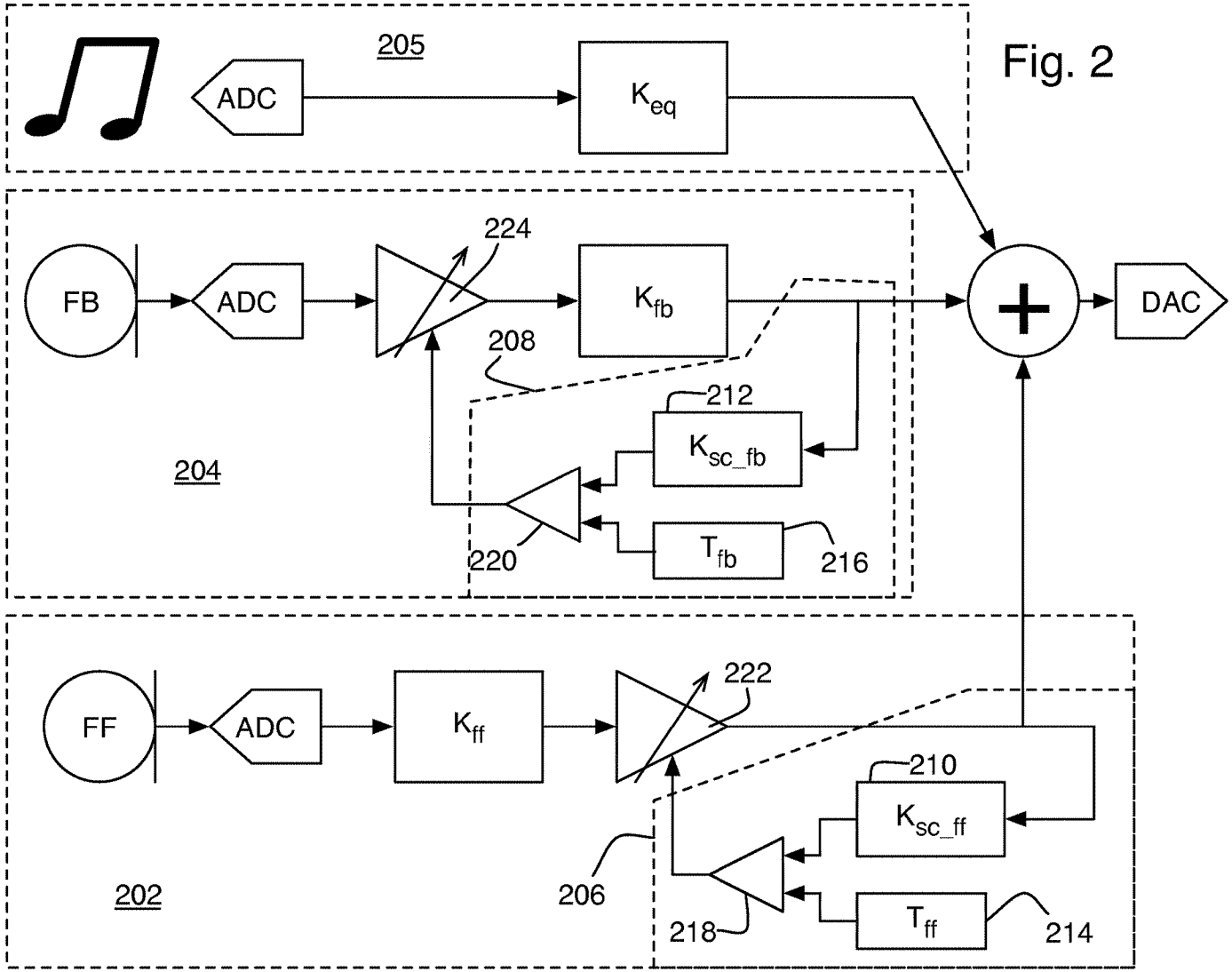
FIGS. 2, 3, 4, 5, and 6 show alternative topologies for signal processing within the headphone of FIG. 1.

One way to address such artifacts is by the addition of side-chain fillers, as shown in FIG. 2 and discussed below. A side-chain filter, that is, a filter that is applied to a signal sampled from the main signal flow to generate a test signal, but does not directly modify the main signal flow, is used to sense a signal approaching a limit at just some frequencies. The output of the side-chain filter is used to initiate a response to the potential problem. This can allow the system to respond and adjust gain based on energy from an event that is problematic, while not responding to signals that are not a problem, such as loud music transients.

FIG. 2 shows modifications to both the feed-forward signal pathway 202 and to the feed-back signal pathway 204 to provide side-chain filtering on both pathways. Although the two modifications are shown simultaneously, they are independent of each other, and in a given application, either one or both may be implemented, and other topology and filter modifications enabled by the above-referenced patents may be implemented.

In both the feed-forward and feed-back pathways shown in FIG. 2, a side-chain loop, 206 or 208, samples the output signal before it is summed with the output signals of the other pathways. The side-chain loops each pass the signal through a filter, $K_{sc_ff}$ (210) for the feed-forward pathway and $K_{sc_fb}$ (212) for the feedback pathway. The output of each filter is compared to a pre-determined threshold, $T_{ff}$ (214) or $T_{fb}$ (216) respectively, by comparators 218 and 220. If either of the side-chain filters 210 and 212 are not implemented, the output signals may be compared to the thresholds 214 and 216 in their raw form to provide simpler stability checks. The outputs of the comparators are fed to variable gain amplifiers (VGAs) 222 and 224 in the respective feed-forward or feed-back signal pathways. If the comparators detect that the filtered output signal is greater than the threshold, they activate the corresponding VGAs to reduce the amplitude of the corresponding signal. Note that in the example of FIG. 2, for the feed-forward loop 206, the side-chain loop is implemented after the $K_{ff}$ filter that shapes the feed-forward signal, while in the feed-back loop 208, the side-chain loop is implemented around the $K_{fb}$ filter that shapes the feed-back signal. Both of these configurations may be altered—with either side-chain loop being implemented before, after, or around the corresponding main-pathway filter, depending on the properties of the system being implemented. The VGAs may similarly be located before or after the corresponding main loop filters.

Figure 3:
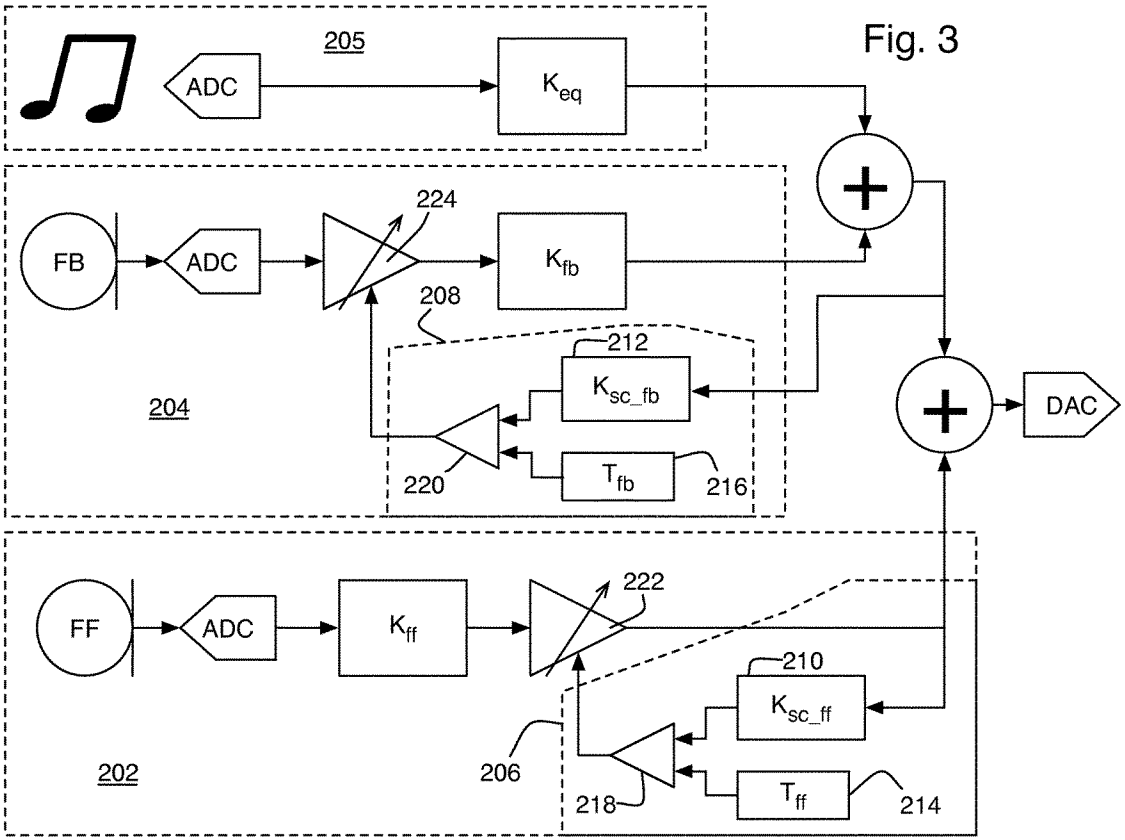
Figure 4:
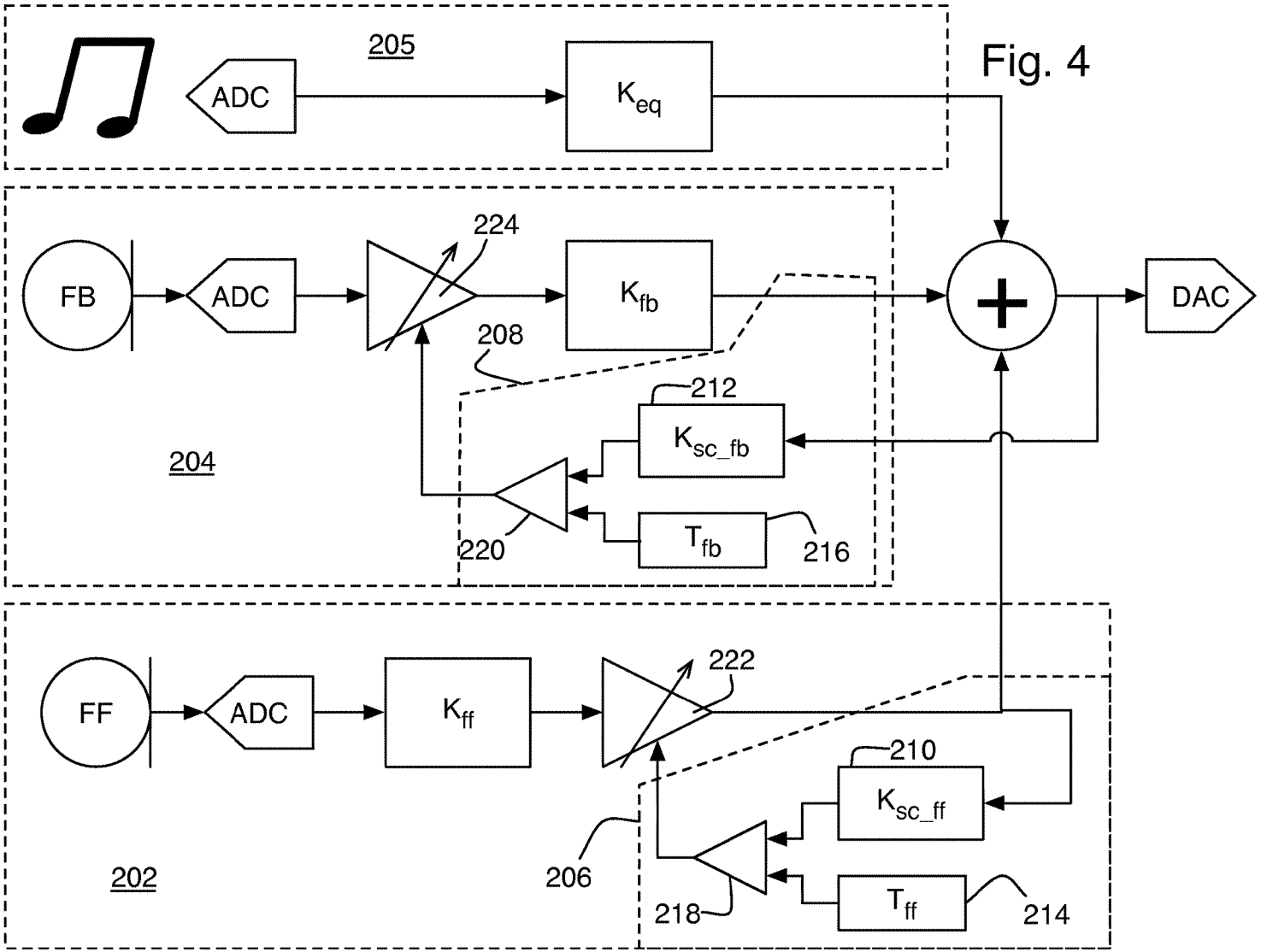

FIGS. 3 and 4 show alternative topologies in which the side-chain loops themselves are the same as in FIG. 2, but the point at which the feed-back side-chain loop samples the output signal is changed. In FIG. 3 the signal for the feed-back side-chain loop 208 is sampled after the feed-back path 204 and the audio input path 205 have been combined with each other but before they are combined with the output of the feed-forward path 202. In FIG. 4, the signal for the feed-back path 204 is sampled after all three signal paths have been combined. In all three examples, the signal for the feed-forward path 202 is sampled before that signal is combined with any others, but that could also be sampled at other points, i.e., after combination with one or both of the other signal paths.

Figure 5:
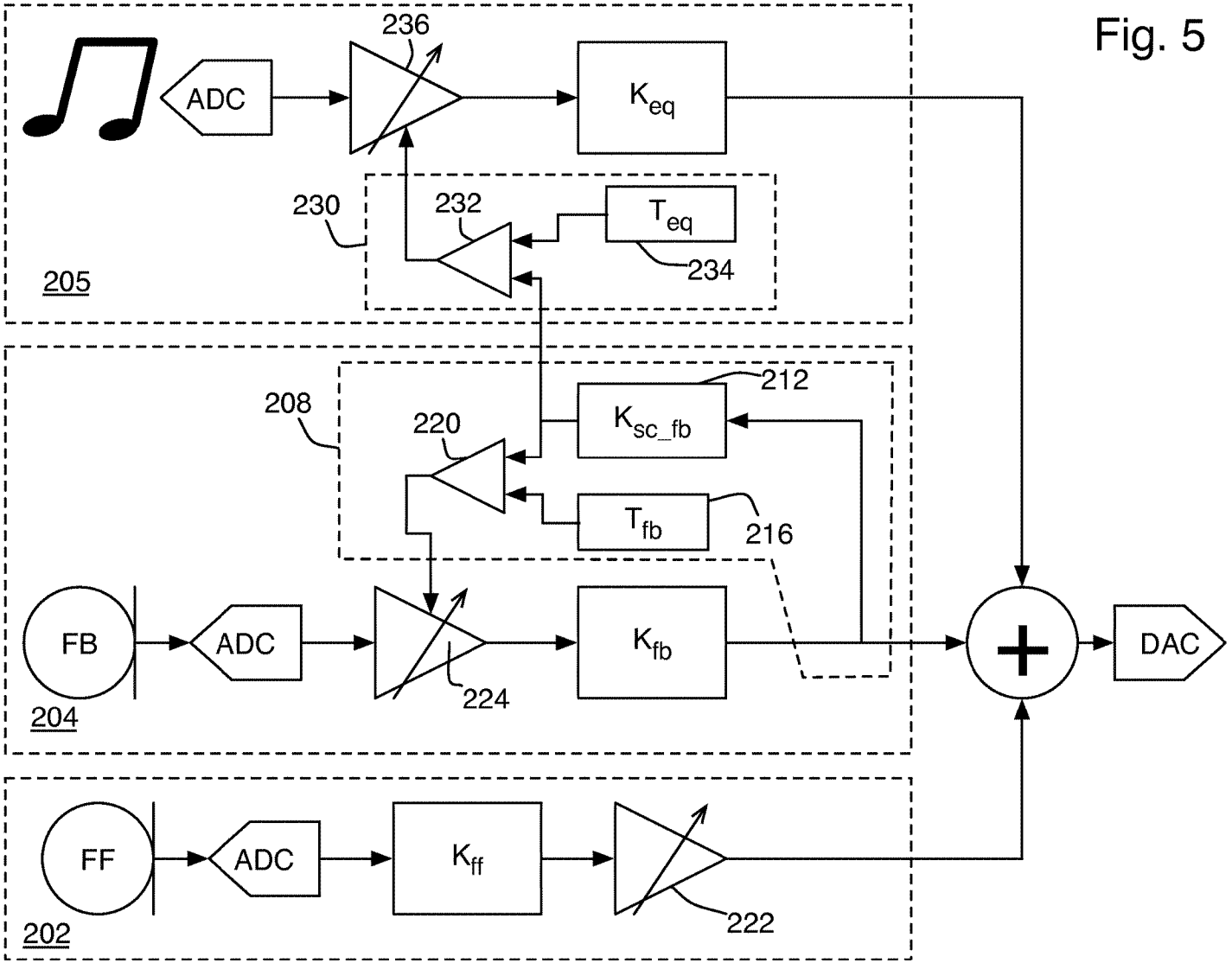

Which topology is used will depend on the causes and consequences of the particular artifacts being detected and the techniques used to mitigate them. FIG. 5 shows yet another topology. The side-chain loop 208 is the same as in FIG. 2, but the output of the $K_{sc_fb}$ filter is also passed to a comparator 232 within a side-chain loop 230 in the audio input path 205, where it is compared to a threshold $T_{eq}$ 234. The output of the comparator 232 controls a VGA 236 to limit the audio input path. The VGA is shown before the $K_{eq}$ audio input filter, but it could also be located after the filter. If the $T_{eq}$ threshold is slightly lower than the $T_{fb}$ threshold, the audio input will be limited before it falsely triggers the limiter in the feed-back path. As with the example of FIG. 2, the input to the $K_{sc_fb}$ filter may be sampled after the feed-back and audio paths are summed, or after all three paths are summed. No side-chain filter is shown in the feed-forward path 202 in FIG. 5, but any of the filter topologies shown or discussed above, or other suitable topologies, may be combined with the topology shown in FIG. 5.

Figure 6:
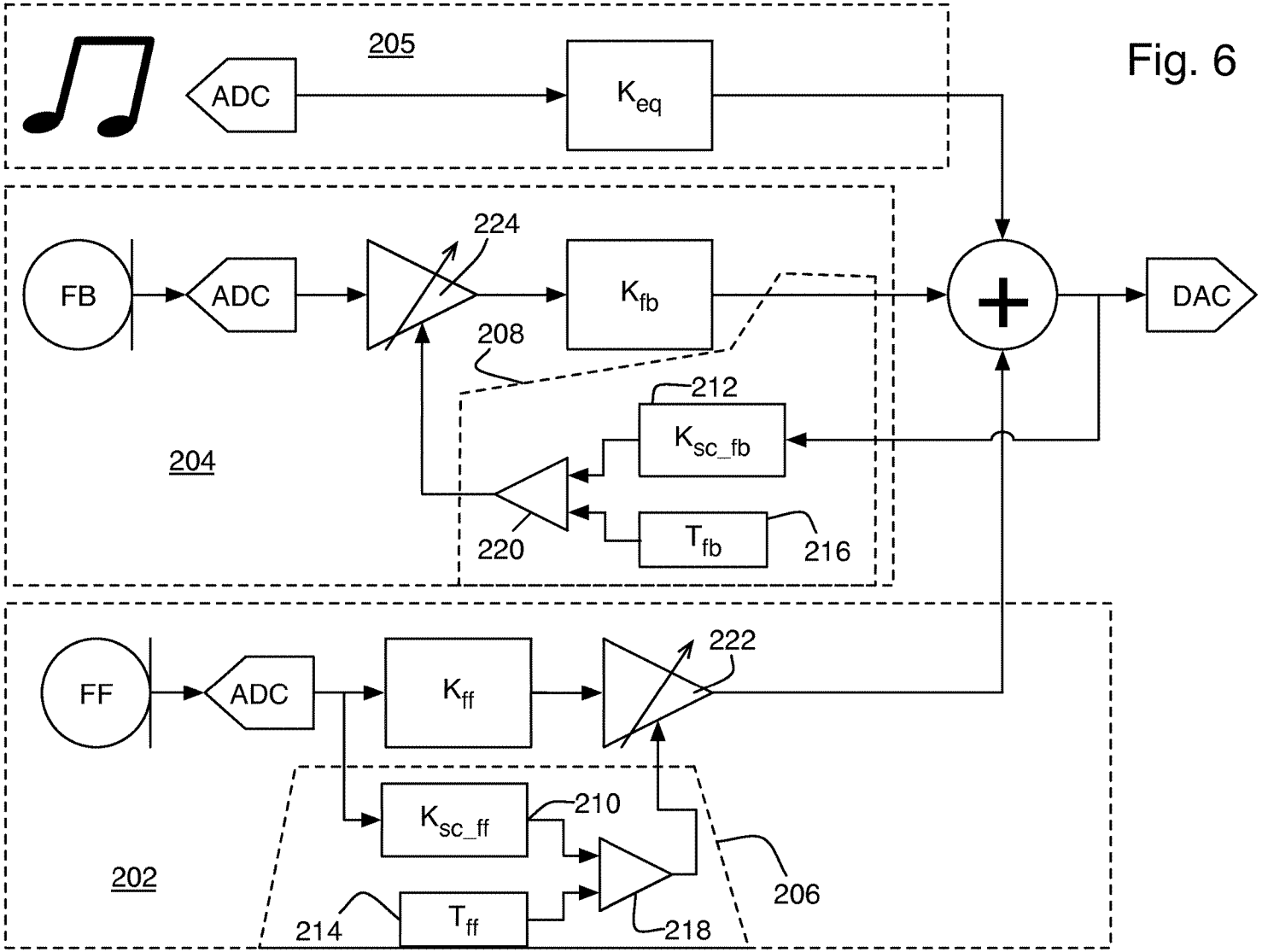

FIG. 6 shows a topology similar to that of FIG. 4, but with the feed-forward side-chain loop 202 sampling the feed-forward signal before either the VGA 222 or the feed-forward filter $K_{ff}$. The side-chain loop is otherwise unchanged and operates as discussed above. They type of forward compressor can react to the raw energy in the incoming signal, prior to any filtering or limiting imposed by the signal pathway, and can also be used with the feed-back side-chain loop or in the audio signal path.

Figure 7:
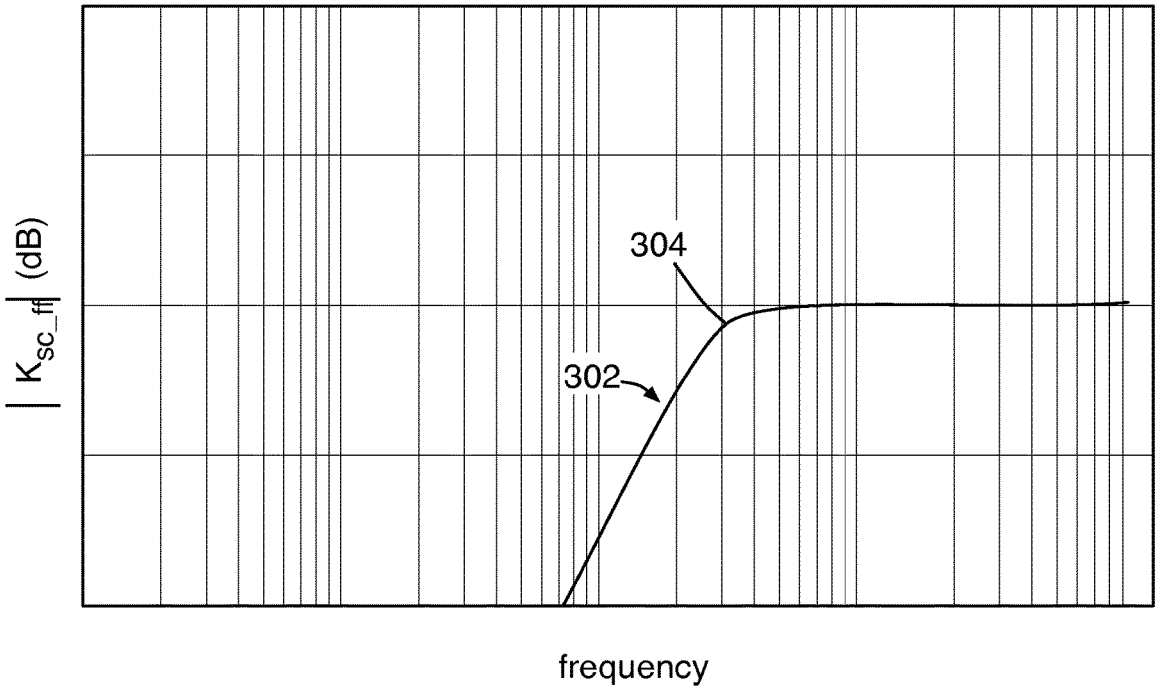
FIGS. 7, 8, 9, and 10 show graphs of filter magnitudes.

FIGS. 7, 8, 9, and 10 show example graphs of filter magnitude for the side-chain fillers. FIG. 7 shows the magnitude 302 of a filter $K_{sc_ff}$ that may be used for the feed-forward side-chain loop. This filter is a simple high-pass filter with a corner frequency 304. In some examples, the unintentional feed-back loop that can be created when the ambient naturalness mode is active and the output driver is acoustically coupled to the feed-forward microphone results in high signal levels above the corner frequency 304. Below that frequency, high signal levels may be present due to a loud ambient environment, but would not be due to the feed-back problem. This filter, therefore, avoids limiting the feed-forward path when the ambient environment is simply loud, but does limit it when the high signal levels are in a frequency range indicative of an unstable feed-back loop having been formed.

Figure 8:
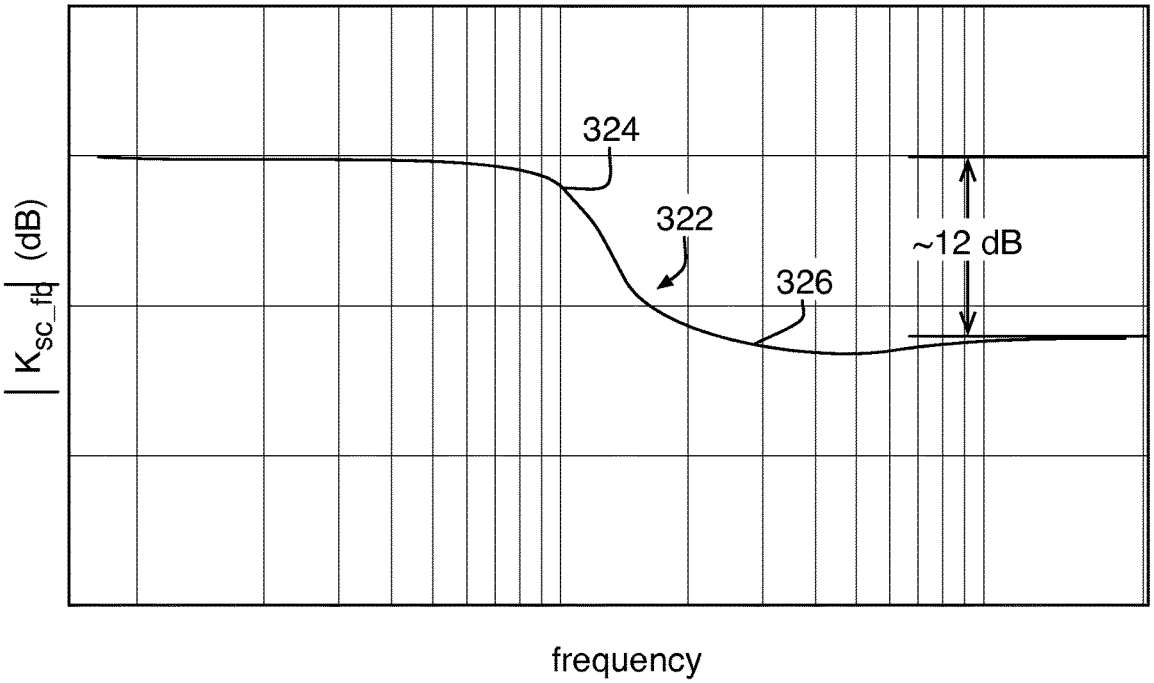

FIG. 8 shows the magnitude 322 of a filter $K_{sc_fb}$ that may be used for the feed-back side-chain loop. This filter passes signals below a first frequency 324 and slightly attenuates signals above another frequency 326. One use for such a filter is to pass signal levels indicative of high driver excursion with frequency content lower than frequency 324 that may result in the acoustical part of the system operating outside the normal linear operating range, so that they can be compared to the threshold to trigger compression when appropriate, but to de-emphasize signals that are loud due to music (reproduced by the driver due to an input signal from the audio pathway 205 in FIGS. 2 through 6) being detected by the feedback microphone. In general, if a signal level is above the threshold, this indicates a condition that may result in instability. One cause of high excursion that might result in instability is physical motion of the headphone, such as when it is being removed. Such events produce high signal levels in the feed-back pathway at lower frequencies, but a detector simply looking for high energy in the feed-back pathway may be misled by the presence of music from the audio input pathway. The transition from passing to attenuating is selected to fall above the frequencies where motion of the headphone causes high signal levels, and below the frequencies where music does the same. The filter 322 attenuates the side chain path by about 12 dB in the range where music may be present, so that it does not falsely trigger the comparator 220. In some examples, a smaller variation may be suitable, such as a 6 dB attenuation.

Figure 9:
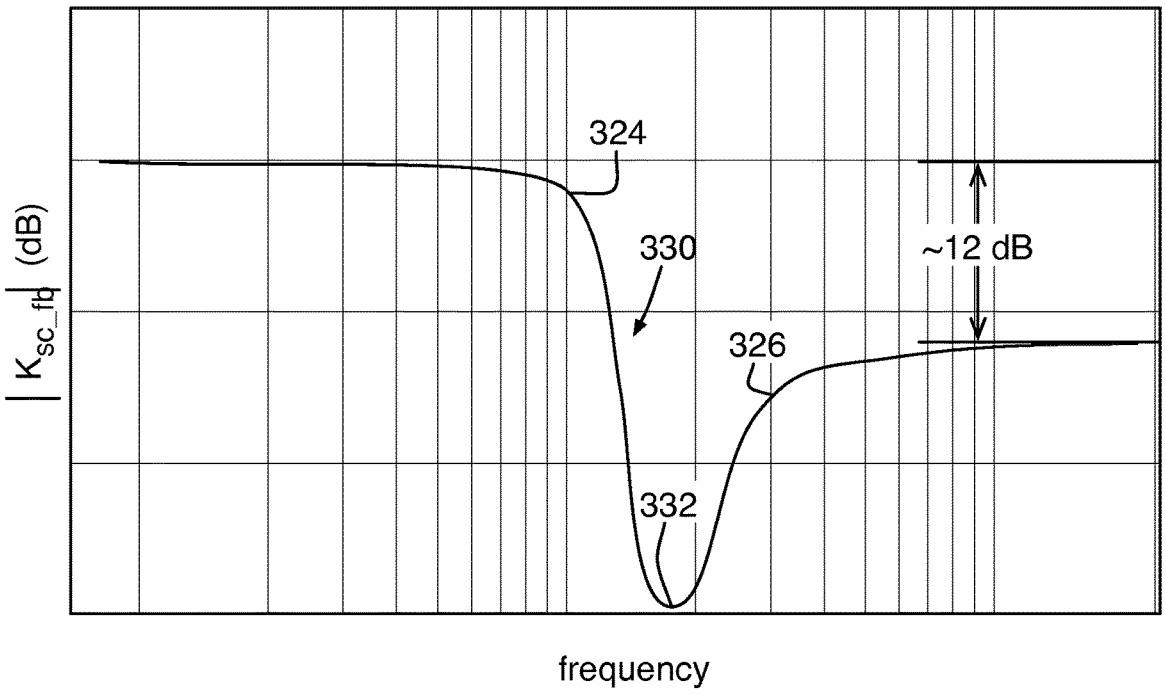

FIG. 9 shows the magnitude 330 of an enhancement to the filter of FIG. 8, in which the filter attenuates the signals to a large degree at the transition between the two frequency ranges, shown by notch 332. The center frequency of the notch in a given implementation will depend on the particular acoustics and circuit characteristics of the headphones. The lowest frequency music is the most likely to bleed over to the range where instability is being monitored, so the filter includes the deep notch 328 before leveling out at the −12 dB level as in FIG. 8. The notch prevents the comparator from triggering too aggressively when the music alone is loud near the sensitive frequencies. In some examples, a notch may be used alone or away from the corner frequency, that is, with the filter having the same magnitude on both sides of the notch.

Figure 10:
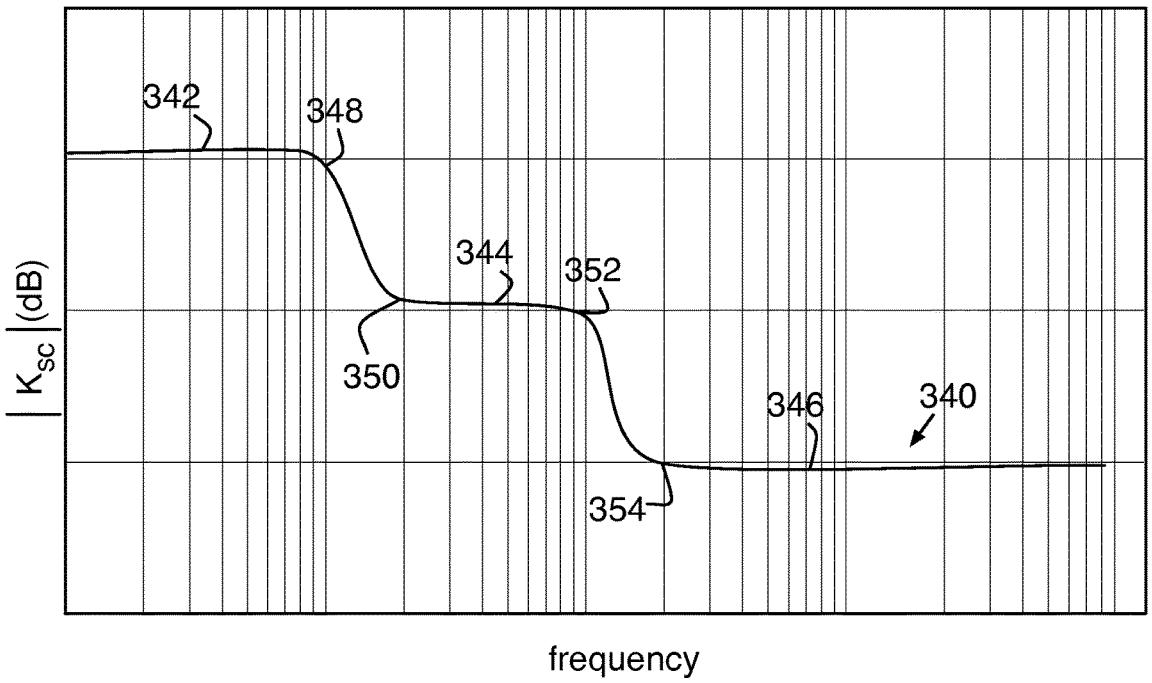

FIG. 10 shows the magnitude 342 of a filter that has three shelf levels 342, 344, and 346. The first shelf 342 applies a first gain to signals below a first corner frequency 348. The second shelf 344 applies a second gain to signals between second and third corner frequencies 350 and 352. The third shell applies a third gain to signal above a fourth corner frequency 354. The corner frequencies could be farther apart, providing for more gradual transitions between the shell levels. Such shelves allow the side-chain loops to apply filtering more selectively, checking for multiple triggering events, or avoiding multiple misleading triggers. The shelves in FIG. 10 are shown with decreasing magnitudes by frequency, but the magnitudes of each shell may follow any pattern. For example, the center shelf 344 could have a magnitude greater than either of the high or low shelves. Notches like that shown in FIG. 9 may also be included between or within each of the shelves.

Each of the filters discussed as applying to a particular one of the side-chain filters $K_{sc_ff}$ or $K_{sc_fb}$ could also be applied to the other. That is, a high-pass filter like that in FIG. 6 could be used in the feed-back side-chain loop, or a shelf filter like those shown in FIGS. 7 and 8 could be used in the feed-forward side-chain loop or in a separately-filtered audio path side-chain loop. Notches between shelves, at corners of high-pass or low-pass fillers, or on their own can also be used in any of the side-chain loops. One common characteristic to the filters, whichever loop they are used in, is that they provide a difference in response of at least 6 dB in at least two different frequency ranges, one of which may be quite narrow, between 10 Hz and 10 kHz (generally, the operating range of the active aspects of an ANR headphone). The tails of the filters may also extend below 10 Hz and above 10 kHz.

All of the various signal topologies and filter designs described above are relatively easily implemented in the configurable digital signal processor described in the cited patents. These topologies and filter designs may also be implemented in analog circuits, or in a combination of analog an digital circuits, using conventional circuit design techniques, though the resulting product may be larger or less flexible than one implemented using an integrated, configurable digital signal processor.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A method of providing stability in an active noise reduction (ANR) headphone, the method comprising:
- measuring a sound field to generate a first input signal;
- in an ANR signal pathway, filtering and applying a variable gain to the first input signal to produce a first filtered signal using a first filter and a first variable gain amplifier;
- outputting the first filtered signal; and
- simultaneously with outputting the first filtered signal,
  - sampling a signal at a point in the ANR signal pathway and filtering the sampled signal using a second filter to produce a second filtered signal, wherein the second filter is disposed in a sidechain feedback path between the first filter and the first variable gain amplifier,
  - comparing the second filtered signal to a threshold, and
  - if the comparison finds that the second filtered signal is greater than the threshold signal,
    - changing the gain of the first variable gain amplifier to attenuate the first filtered signal
    - wherein the second filter applies first and second gains in respective first and second frequency ranges between 10 Hz and 10 kHz, the first frequency range being lower than the second frequency range and the second gain attenuating the sampled signal by at least 6 dB compared to the first gain.

2. The method of claim 1, wherein the second filter passes signals within the first frequency range that are indicative of instability in the ANR signal pathway.

3. The method of claim 1, wherein the second filter comprises a multiple shelf filter that applies a first gain to signals below a first frequency range, applies a second gain to signals within the first frequency range, and applies a third gain to signals above the first frequency range.

4. The method of claim 1 wherein the second filter attenuates signals in the second frequency range, in which high signal levels may result in instability in the ANR signal pathway, by at least 6 dB and passes signals in the first frequency range.

5. The method of claim 1 wherein the second filter attenuates signals completely at a frequency defining the lower bound of the second frequency range.

6. The method of claim 1, wherein the sampling provides the first filtered signal to the second filter.

7. The method of claim 1, wherein the sampling provides the first input signal to the second filter.

8. The method of claim 1, wherein the first variable gain amplifier is located before the first filter.

9. The method of claim 1, wherein the first variable gain amplifier is located after the first filter.

10. The method of claim 1, wherein the ANR signal pathway comprises a feed-forward ANR pathway, and the sound field is measured outside the ANR headphone as an input to the feed-forward ANR pathway.

11. The method of claim 1, wherein the ANR signal pathway comprises a feed-back ANR pathway, and the sound field is measured inside the ANR headphone as an input to the feed-back ANR pathway, the first and second filtered signals being first and second filtered feed-back signals.

12. The method of claim 11, further comprising combining the first filtered feed-back signal with a filtered input audio signal to produce a first combined signal, and wherein the sampling provides the first combined signal to the second filter.

13. The method of claim 12, wherein the sampling provides the first combined signal to the second filter after the first combined signal is further combined with a filtered feed-forward signal to produce a second combined signal.

14. The method of claim 11, further comprising:

comparing the second filtered feed-back signal to a second threshold, and if the comparison finds that the second filtered feed-back signal is greater than the second threshold at any frequency, changing the gain of a second variable gain amplifier on an audio input path to attenuate an audio input signal.

15. The method of claim 14, wherein the second threshold is less than the first threshold.

16. The method of claim 11, further comprising:

measuring a sound field outside the ANR headphone to generate a first input feed-forward signal;

in a feed-forward ANR pathway, filtering and applying a variable gain to the first input feed-forward signal to produce a first filtered feed-forward signal using a third filter and a second variable gain amplifier;

outputting the first filtered feed-forward signal;

combining the first filtered feed-forward signal with the first filtered feed-back signal to produce a combined output signal; and simultaneously with outputting the first filtered feed-forward signal, sampling a signal at a point in the feed-forward ANR pathway and filtering the sampled signal using a fourth filter to produce a second filtered feed-forward signal, comparing the second filtered feed-forward signal to a second threshold, and if the comparison finds that the second filtered feed-forward signal is greater than the second threshold, changing the gain of the second variable gain amplifier to attenuate the first filtered feed-forward signal, wherein the fourth filter applies third and fourth gains in respective third and fourth frequency ranges between 10 Hz and 10 kHz, the third and fourth gains being different by at least 6 dB.

17. The method of claim 16, wherein the fourth filter comprises a high-pass filter that attenuates signals below a first high pass frequency range and passes signals within the first high pass frequency range that are indicative of instability in the feed-forward ANR pathway.

18. The method of claim 17, wherein the fourth filter attenuates signals in the fourth frequency range, in which high signal levels may result in instability in the feed-back ANR pathway, by at least 6 dB and passes signals in the third frequency range.

19. The method of claim 1, wherein the ANR signal pathway is implemented using a configurable digital signal processor.

20. An active noise reduction (ANR) system comprising:

a feed-back ANR signal pathway comprising a feed-back microphone, a first variable gain amplifier, and a first filter;

a feed-forward ANR signal pathway comprising a feed-forward microphone, a second variable gain amplifier and a second filter;

an audio input signal pathway; and an output transducer converting signals from each of the feed-back ANR signal pathway, the feed-forward ANR signal pathway, and the audio input signal pathway to acoustic output signals, at least one of the feed-back ANR signal pathway and the feed-forward ANR signal pathway further comprising a first side-chain loop sampling a signal within the respective pathway, applying a third filter to the sampled signal, and adjusting at least the first or second variable gain amplifier based on a comparison of the output of the third filter to a threshold, wherein the first side-chain loop is disposed in a feedback path between one of (i) the first filter or (ii) the second filter, and the (i) first variable gain amplifier or (ii) the second variable gain amplifier, respectively, wherein the third filter applies first and second gains in respective first and second frequency ranges between 10 Hz and 10 kHz to the sampled signal, the first frequency range being lower than the second frequency range and the second gain attenuating the sampled signal by at least 6 dB compared to the first gain.

21. The active noise reduction system of claim 20, wherein the first side-chain loop samples a signal output by the feed-back ANR signal pathway and the third filter attenuates signals in the second frequency range, in which high signal levels may result in instability in the feed-back ANR signal pathway, by at least 6 dB and passes signals in the first frequency range.

22. The active noise reduction system of claim 21, wherein the audio signal pathway comprises a third variable gain amplifier, and a second side-chain loop receives the output of the third filter from the first side-chain loop and adjusts the third variable gain amplifier based on a comparison of the output of the third filter to a second threshold.

23. The active noise reduction system of claim 20, wherein the first side-chain loop samples a signal output by the feed-forward ANR signal pathway and the third filter passes signals within the first frequency range that are indicative of instability in the feed-forward ANR signal pathway.

24. The active noise reduction system of claim 20, wherein the first side-chain loop samples a summed signal comprising a signal output by the feed-back ANR signal pathway and a signal output by the audio input signal pathway.

25. The active noise reduction system of claim 20, wherein the first side chain loop samples a signal from within one of the feed-back or feed-forward ANR signal pathways prior to the first or second variable gain amplifiers and first or second filters.

26. The active noise reduction system of claim 20, wherein the feed-forward and feed-back ANR signal pathways comprise an integrated configurable digital signal processor.

27. A method of providing stability in a digital feed-back loop of an active noise reduction (ANR) headphone, the method comprising:

measuring a sound field inside the ANR headphone to generate a first input feed-back signal;

in a feed-back ANR pathway, filtering and applying a variable gain to the first input feed-back signal to produce a first filtered feed-back signal using a first filter and a first variable gain amplifier;

outputting the first filtered feed-back signal; and simultaneously with outputting the first filtered feed-back signal, sampling the feed-back signal at a point in the feed-back ANR pathway and filtering the sampled signal using a second filter to produce a second filtered feed-back signal, wherein the second filter is disposed in a sidechain feedback path between the first filter and the first variable gain amplifier, comparing the second filtered feed-back signal to a threshold, and if the comparison finds that the second filtered feed-back signal is greater than the threshold signal, changing the gain of the first variable gain amplifier to attenuate the first feed-back signal, wherein the second filter applies first and second gains in respective first and second frequency ranges between 10 Hz and 10 kHz, the first frequency range being lower than the second frequency range and the second gain attenuating the sampled signal by at least 6 dB compared to the first gain.

28. A method of providing stability in a digital feed-forward pathway of an active noise reduction (ANR) headphone, the method comprising:

measuring a sound field outside the ANR headphone to generate a first input feed-forward signal;

in a feed-forward ANR pathway, filtering and applying a variable gain to the first input feed-forward signal to produce a first filtered feed-forward signal using a first filter and a first variable gain amplifier;

outputting the first filtered feed-forward signal; and simultaneously with outputting the first filtered feed-forward signal, sampling the feed-forward signal at a point in the feed-forward ANR pathway and filtering the sampled signal using a second filter to produce a second filtered feed-forward signal, wherein the second filter is disposed in a sidechain feedback path between the first filter and the first variable gain amplifier;

comparing the second filtered feed-forward signal to a threshold; and if the comparison finds that the second filtered feed-forward signal is greater than the threshold signal, changing the gain of the first variable gain amplifier to attenuate the first filtered feed-forward signal, wherein the filter for producing the second filtered feed-forward signal applies first and second gains in respective first and second frequency ranges between 10 Hz and 10 kHz, the first frequency range being lower than the second frequency range and the second gain attenuating the sampled signal by at least 6 dB compared to the first gain.

* * * * *